US005163563A

United States Patent [19]

Coppolani

[11] Patent Number: 5,163,563

[45] Date of Patent: Nov. 17, 1992

[54] APPARATUS FOR SORTING ELONGATED PRODUCE, SUCH AS FRENCH BEANS

[75] Inventor: Joseph Coppolani, Meudon La Foret, France

[73] Assignee: Femia Industrie, France

[21] Appl. No.: 680,323

[22] Filed: Apr. 4, 1991

[30] Foreign Application Priority Data

Apr. 10, 1990 [FR] France ..... 90 04596

[51] Int. Cl.[5] ..... B07C 5/06

[52] U.S. Cl. ..... 209/664; 209/288; 209/394; 209/626

[58] Field of Search ..... 209/664, 626, 621, 683, 209/291, 393, 394, 395, 288

[56] References Cited

U.S. PATENT DOCUMENTS

| | | | |
|---|---|---|---|
| 1,295,642 | 2/1919 | Urschel | 209/626 |
| 1,689,254 | 10/1928 | Ryder | 209/664 |
| 2,241,977 | 5/1941 | Buck | 209/626 |
| 4,049,124 | 9/1977 | Coppolani et al. | 209/664 |
| 4,361,239 | 11/1982 | Kumandan | 209/664 |
| 4,873,105 | 10/1989 | Coppolani et al. | 209/664 X |

FOREIGN PATENT DOCUMENTS

| | | |
|---|---|---|
| 0296985 | 12/1988 | European Pat. Off. . |
| 1140961 | 3/1957 | France . |
| 1355026 | 12/1964 | France . |
| 1474972 | 3/1967 | France . |

*Primary Examiner*—Donald T. Hajec

*Attorney, Agent, or Firm*—Ostrolenk, Faber, Gerb & Soffen

[57] ABSTRACT

The present invention relates to an apparatus for sorting elongate produce comprising a drum constituted by longitudinal grids, stationary and movable bars of which are mounted transversally to the longitudinal axis of the drum, the movable bars of each grid being kept in a fixed position one with respect to the other at constant and identical distances through a frame which is able to be moved relative to the stationary bars in a direction parallel to the longitudinal axis of the drum.

21 Claims, 6 Drawing Sheets

4
9
9a
9d
12
13
14
16
18
19
19a
50

APPARATUS FOR SORTING ELONGATED PRODUCE, SUCH AS FRENCH BEANS

BACKGROUND OF THE INVENTION

The present invention relates to an apparatus for sorting elongated produce, such as French beans.

First certificate of addition No. 84 405 to French patent No. 1,355,026 discloses an embodiment of a known sorting apparatus. The sorting apparatus as taught in this certificate of addition, comprises a rotatable drum constituted by longitudinal bars, which are alternatively stationary and movable radially. The relative space or distance therebetween is capable of being changed in order to increase travel of produce at the upper part of the bars to allow produce eventually jammed between the bars to disengage therefrom. The ends of the movable bars are maintained in contact with a saw-toothed internal toothing ring fixed to an annular flange of the drum, the ring being slightly rotatable relative to this flange, to adjust at will the position of the movable bars with respect to the stationary bars and thereby bringing the sorting interval to a desired size.

However, the provision of the above ring does not allow an accurate adjustment of the sorting interval. Moreover, the movable bars cross or pass through elongated slots of pieces fixed to the internal face of the flanges and corresponding elongating slots in the flanges, so that the movable bars can slide therein. It is extremely difficult, due to the size of these elongated slots to allow the movable bars to be positioned at rigorously identical constant spaces relative to the fixed bars. In other words, the sorting space, once adjusted, is not constant because in the course of time wearing in particular due to the abrasion of the movable bars onto the saw-teeth of the ring is produced, leading to a change of each sorting space. Finally, the prior sorting apparatus needs the use of a very great number of parts including grooved pulleys carried by the ends of the movable bars and springs permanently maintaining the movable bars in a position remote from the center of the drum and close to the stationary bars adjacent thereto. These springs also allow the movable bars to move off the stationary bars to release produce jammed between the bars.

SUMMARY OF THE INVENTION

The purpose of the present invention to eliminate the above drawbacks of the known sorting apparatus by proposing a sorting apparatus so arranged as to permit an accurate adjustment of the sorting space, make invariable the sorting space and once adjusted, while permitting identical sorting intervals.

In this respect, the sorting apparatus according to the invention of the kind including a rotatable drum with alternatively stationary and movable bars, the relative position of which is adjustable so as to bring the sorting interval between adjacent bars to a desired size, is characterized in that the drum is constituted by longitudinal grids. The stationary and movable bars of which are mounted transversally to the longitudinal axis of the drum and the movable bars of each grid are mounted in stationary positions to each other at identical and constant spaces with a frame which can be moved relative to the stationary bars in a direction parallel to the longitudinal axis of the drum by means for controlling the adjustment of the sorting interval.

According to another feature of the invention, the stationary bars of the grids are fixed at their ends to stationary supporting bars which are parallel to the drum axis and disposed circumferentially between the two annular flanges of the drum, two bars of a grid each including a longitudinal row of non-circular apertures intended to accommodate and axially guide complementary-shaped non-circular joining pieces of the movable bars, the free ends of which are fixed to the frame.

Preferably, the non-circular joining pieces of the movable bars have a square cross-section and are guided in their respective apertures with an extremely small clearance.

Advantageously, the walls of the apertures intending to guide the joining pieces have a lining made from a material having a capacity for resistance to wear, such as chrome.

Each supporting bar includes a base small bar on which is mounted an elongated plate extending along the small bar through spacer studs keeping the plate spaced from the small bar, thereby defining the non-circular apertures between the different studs, respectively.

The apparatus further comprises circumferential spacer longitudinal beams joining the two annular flanges of the drum and each having the shape of a hexagonal prism having two wide and narrow surfaces which are parallel, two adjacent small bars of two adjacent grids being carried respectively by two surfaces of the prism adjacent to the narrow surface.

Each stationary bar includes an upper flat part secured at its two ends respectively on two elongated plates of two supporting bars of a grid by two fastening screws, each screwed through the elongated plate, a spacer stud, a base small bar and also screwed in a threaded blind hole of the corresponding spacer longitudinal beam. A bucket part opens laterally towards the lateral wall of a bucket part of the adjacent stationary bar, so that a movable bar can be moved between a position inside the bucket part of a stationary bar and a position close to the lateral wall of the bucket part of the adjacent stationary bar.

Advantageously, the bucket parts of some of the stationary bars are extended at their bottom by deflector means, bringing the elongated produce in a position favorable to their exhaustion.

The free ends of the movable bars cross two parallel arms, respectively, of two longitudinal angular steels of the frame and are fixed thereto with fixing nuts screwed on the free ends.

The means for controlling the adjustment of the relative position of grid movable bars include a plurality of radial levers pivotally mounted outside the drum through fork joints fixed to one of the annular flanges of the drum and each mechanically coupled by one of their lever arms to a connecting cross piece of the angular steels of a frame; a non rotative element capable of being moved in an axial translational motion during the adjustment of the sorting intervals, acting simultaneously on the ends of the lever arms opposite to thoses connected to the frame cross pieces and immobilized in their axial translational motion once the adjustment is made; and an assembly for controlling the movable element.

Advantageously, the movable element is a nut with micrometric displacement on a sleeve rotatably mounted on a cylindrical piece fixed to the annular flange coaxially to the longitudinal axis of the drum.

The nut having a flange forms a travelling path for rollers parallel to the longitudinal axis of the drum and fixed to the free ends of the lever arms opposite to those connected to the frame cross pieces.

Preferably, the control assembly includes a stationary moto-reductor, the output shaft of which carriers a pinion driving an annular gear fixed to the sleeve.

The movable element includes a plurality of brackets fixed to stationary emplacements through fastening screws crossing oblong holes of the brackets.

The flange of the movable element includes a cam part permitting the increase of the distance of the movable bars with respect to the stationary bars at the upper part of the bars, for disengaging produce eventually jammed between the bars.

In order to decrease the height of effective drop of elongated products, it is desirable to use an inner drum coaxial with the the drum and rotatably solid with the latter, the inner drum being provided with at least one strip wound in a helicoidal manner around its axis like at least one screw thread and with radial walls extending in a parallel direction with the longitudinal axis of the drum while being angularly spaced from one another so as to define, with the turns of the helicoidal strips, compartments for receiving and transporting the treated produce.

The present invention will be better understood and other objects, features, details and advantages thereof will appear more clearly as the following explanatory description proceeds with reference to the appended drawings given by way of example only illustrating an embodiment of the invention, and wherein:

DESCRIPTION OF A PREFERRED EMBODIMENT

Figure 1:
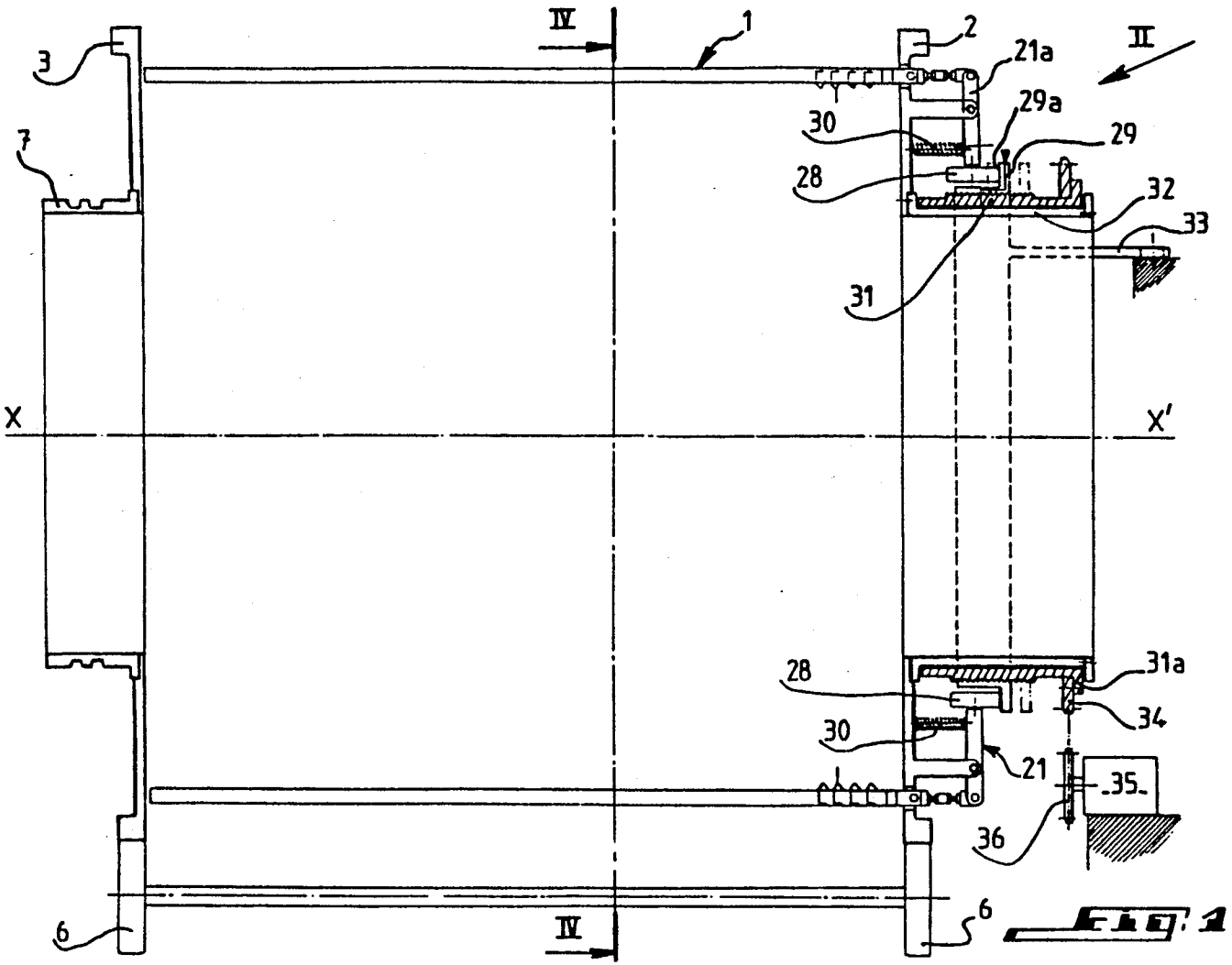
FIG. 1 shows a longitudinal cross-sectional view of the sorting apparatus according to the invention.

Referring to the Figures, the apparatus for sorting elongated produce, such as French beans, includes a rotative cylindrical drum 1 constituted by two annular flanges 2, 3 joined together by spacer longitudinal beams 4 parallel to the longitudinal axis of rotation X-X' of the drum 1 and disposed along a same circumference. The longitudinal beams 4 include outermost threaded fingers 4*a* passing through corresponding perforations 5 formed through the two flanges 2, 3. Nuts (not shown) are screwed on the fingers 4*a* for assembling the drum flanges 2, 3. The drum 1 is supported in rotation by two pairs of opposite rollers 6, the rotation axis of which are solid with a housing (not shown) and contacting two external annular walls of the flanges 2, 3, respectively. The drum 1 is driven in rotation about its axis X-X' with a driving device having an electrical motor and a driving belt (not shown), the latter partially winding around a driving crown 7 solid with the annular flange 3.

According to the invention, the drum 1 has its lateral surface constituted by a plurality of longitudinal grids 8 defining in a cross-sectional view of the drum a regular polygon having a number of sides sufficient to define the drum 1. In the present case, twelve grids are provided, thereby forming a dodecagon. The grids 8 are supported by the longitudinal beams 4 as it will explained below.

Each grid 8 includes alternative stationary bars 9 and movable bars 10 disposed transversally to the longitudinal axis X-X' of the drum 1. The relative position of the bars 10 is adjustable so as to adjust the sorting interval or space d between adjacent bars 9, 10 to a desired size.

The stationary bars 9 of a grid 8 are fixed at their ends to stationary supporting bars 11 parallel with axis X-X' of the drum 1 and carried between the two flanges 2, 3 through two successive longitudinal beams 4. Each bar 11 includes a base small bar 12, carried by a longitudinal beam 4, and on which is mounted an elongated plate 13 extending along the small bar 12 through spacer studs 14 keeping the plate 13 spaced from the small bar 12, thereby defining non-circular apertures 15 between the different studs 14, respectively, these aperture having preferably a square cross-section. Each longitudinal beam 4 has the shape of a hexagonal prism including wide and narrow parallel surfaces 4*b* and 4*c*. Two adjacent small bars 12 of two adjacent grids 8, respectively, are carried by two prism surfaces 4*d*, 4*e*, respectively, adjacent to the narrow surface 4*c* of a longitudinal beam 4. Two supporting bars 11 of a grid 8 thus define respectively two parallel longitudinal rows of apertures 15 facing each other.

Figure 3:
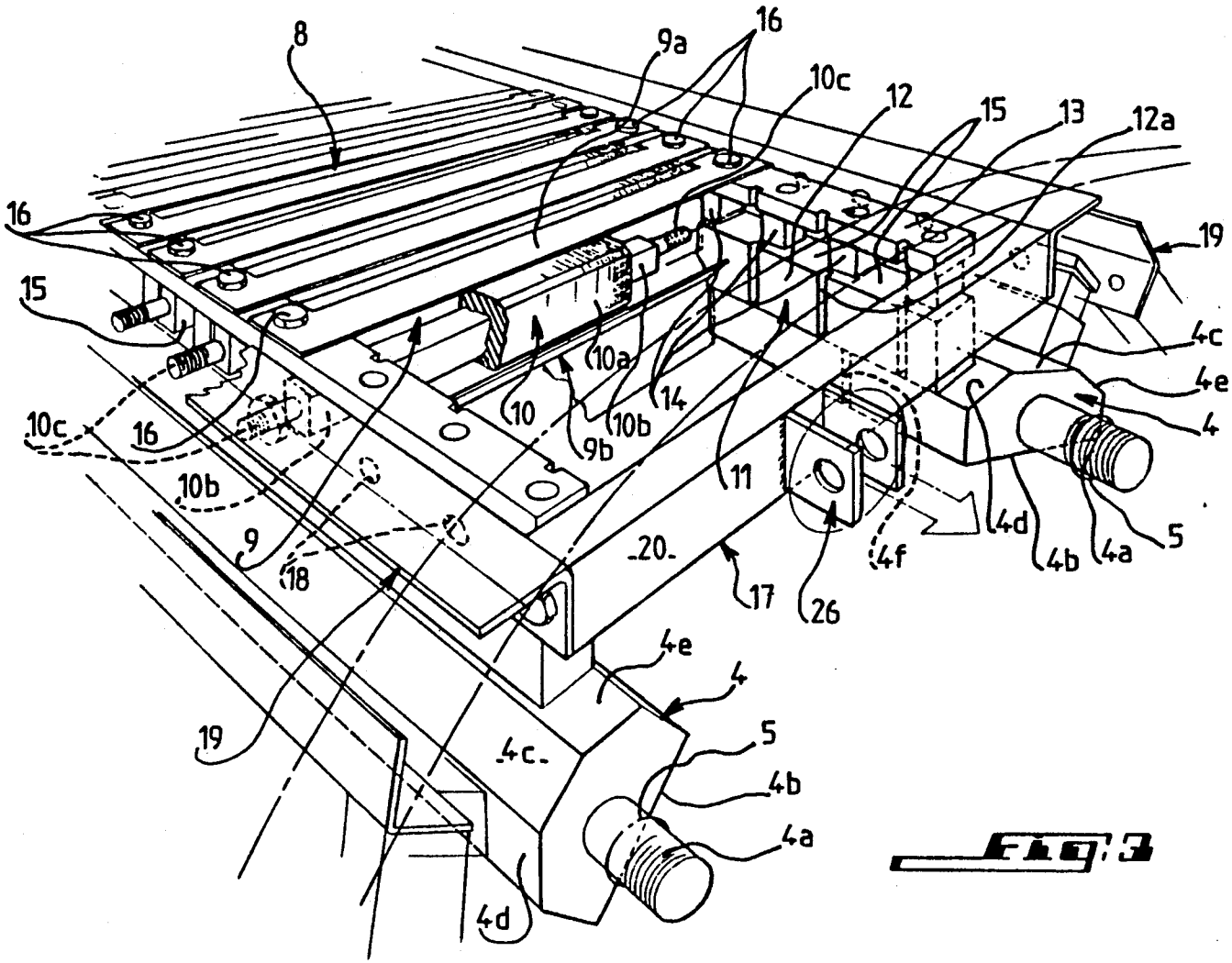
FIG. 3 is a partial perspective view along arrow III of FIG. 2.
Figures 8, 9:
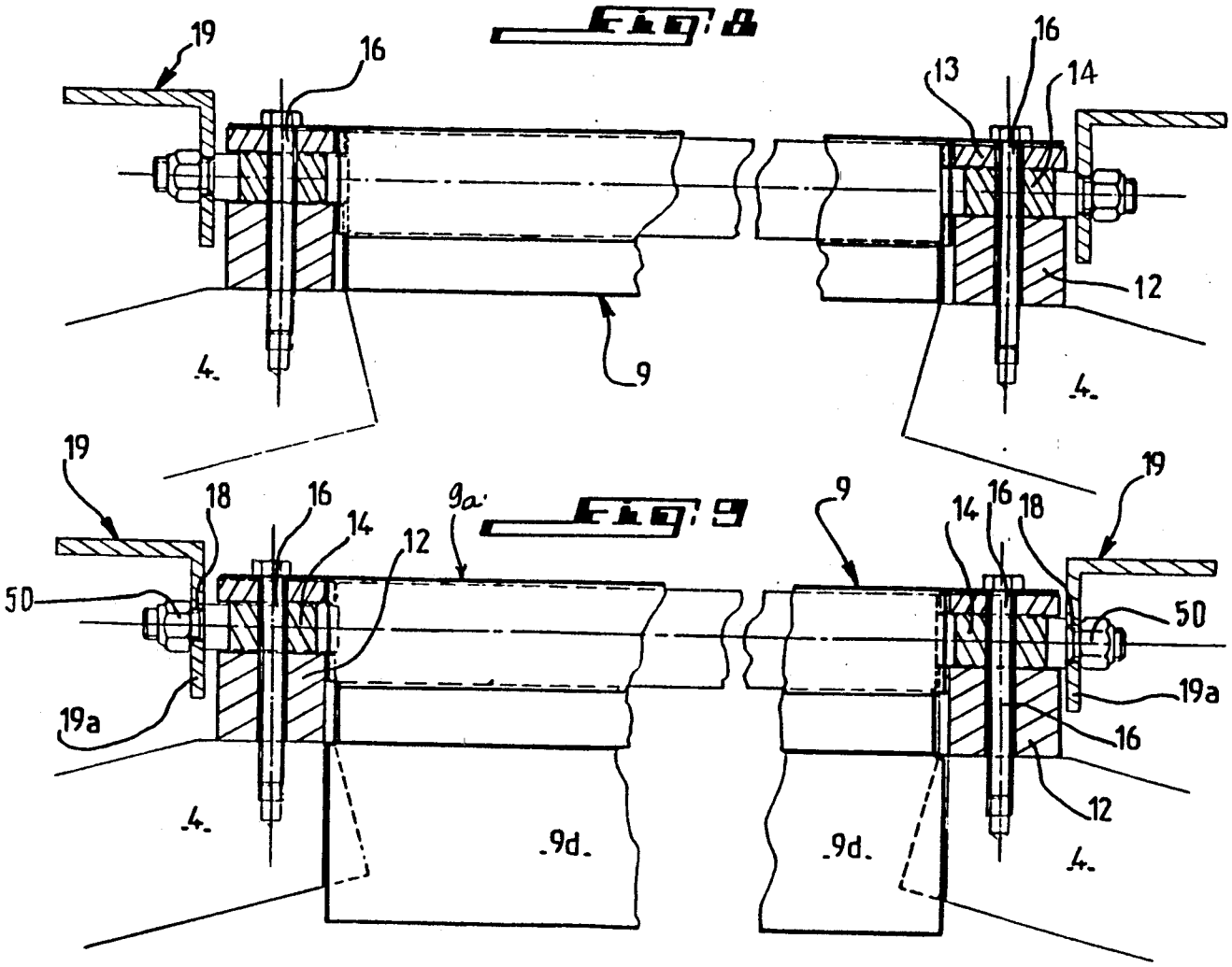
FIG. 8 is a sectional view along line VIII—VIII of FIG. 5.
FIG. 9 is a sectional view along line IX—IX of FIG. 5.

Each stationary bar 9 includes an upper flat part 9*a* secured at its two ends respectively on two elongated plates 13 of two supporting bars 11 of a grid 8 through two fastening screws 16. Each screw 16 passes through an elongated plate 13, a spacer stud 14, a base small bar 12 and is screwed in a threaded blind hole of a corresponding longitudinal beam 4 machined transversally to the surface 4*d* or 4*e* of the elongated beam (FIG. 9). Each stationary bar 9 further includes a bucket-shaped part 9*b* which opens laterally toward the radial lateral wall 9*c* of the bucket-shaped part of the adjacent stationary bar 9 so that a movable bar 10 can be moved or displaced between a position inside the bucket-shaped part of a stationary bar 9 and a position close to the lateral wall 9*c* of the bucket-shaped part 9*b* of the adjacent stationary bar 9. Thus, the sorting interval d is defined between a lateral wall 9*c* of a bucket 9*b* of a bar 9 and a radial lateral face 10*a* of the movable bar located between the stationary bar 9 and the stationary bar 9 preceding it, the face 10*a* of the movable part being parallel to the face 9*c* of the stationary bar. A plurality of stationary bars 9 include deflector means 9*d* solid with bottoms of the respective buckets 9*b* and extend substantially perpendicular to the axis X-X' of the drum 1. For example, a deflector means 9*d* is provided on every fourth stationary bar. To facilitate the assembly of stationary bars 9 between two supporting bars 11, radial notches 12*a* and 4*f* are provided respectively in the inner lateral faces of small bars 12 and longitudinal beams 4 for accommodating the corresponding opposite ends of the lateral walls 9*c* perpendicular to flat parts 9*a* and of deflectors means 9*d* of stationary bars 9 (FIG. 3). Each notch 12*a* is shifted with respect to notch 4*f* in the case of a stationary bar 9 with a deflector means 9*d*, while it is understood that one notch 12*a* is sufficient to accommodate the corresponding end of a face 9*c* of a stationary bar 9 having no deflector means 9*d*. The stationary bars 9 are fixed one with respect to the other at equal intervals. The movable bars 10 of each grid 8 are maintained in a fixed position to each other at identical constant distances through a longitudinal frame 17 disposed between the two flanges 2, 3 and being able to be moved relative to the stationary bars 9 along a direction parallel to the axis X-X' of the drum 1 through means for controlling the adjustment of the sorting interval d, which and which will be described below. More precisely, each movable bar 10 comprises two opposite non-circular joining pieces 10*b*, in the present case with a square cross-section, passing through respective aligned apertures 15 in order to be longitudinally guided therein with a very small clearance. Advantageously, the parallel faces of each aperture 15 defined by the plate 13 and the subjacent small bar 12, respectively, and guiding in axial translational motion the corresponding joining piece 10*b*, are lined with a material having a capacity of resistance to wear, such as chrome. Joining pieces 10*b* of a movable bar are extended by threaded fingers 10*c*, respectively, passing through aligned drillings 18 of longitudinal and parallel branches 19*a* of angle steels 19 of the frame 17, extending along both sides of supporting bars 11 of a grid 8 and connected therebetween through a cross piece 20. The movable bars 10 of a grid 8 are thus fixed between two angle steels 19 with nuts 50 screwed on the threaded fingers 10*c*.

The movable bars 10 each have a bevelled or chamfered lower part facing the inside of the drum 1 so as to constitute along with the roof-shaped walls of the bucket 9*b* and the deflector means 9*d* hoppers bringing the elongated produce H at a position favourable to their exhaustion through the sorting intervals.

The means for controlling the adjustment of the position of the movable bars 10 relatively to the stationary bars 9 comprise a plurality of radial levers 21 corresponding to the number of frames 17 and pivotally mounted outside the drum 1 through fork joints 22 solid with the annular flange 2 and located on a same circumference. More precisely, each lever 21 has its upper lever arm 21*a* ending with a fork joint connected to an adjusting means having two threaded rods 23 with left and right pitches, respectively, and a sleeve 24 for connecting the rods 23 and nuts 25. The rod 23 opposite to the one connected to the fork joint of the arm 21*a* being fastened to a fork joint 26 solid with a cross piece 17 at the half part thereof. The assembly formed by the fork joint 26 and the rod 23 passes through a drilling 27 of the flange 2 in order to allow a free longitudinal displacement or movement of this assembly. The lever arm 21*b* opposite to the arm 21*a* of each lever 21 has at its lower end a freely rotating roller 28 which extends parallel to the axis X-X' of the drum. The rollers 28 of the levers 21 are in contact with a guiding path formed by a flange 29*a* of a nut element 29 which is movable in axial translational motion during the simultaneous adjustment of the sorting intervals and co-operating with the rollers 28 so as to pivot the levers 21 in one direction or the other depending on whether one wishes to increase or decrease the sorting intervals. Elastic means 30, such as compressing springs, are mounted prestressed between the flange 2 and the lever arms 21*b* so as to constantly bring the rollers 28 to bear upon the flange 29*a* of the element 29. This element 29 micrometically moves on a sleeve 31 having a micrometric thread machined on a portion of its length and rotativly mounted on a cylindrical piece 32 solid with the flange 2 coaxially to axis X-X'. The nut element 29 is locked in rotation once the sorting intervals have been adjusted by right angle fastening brackets 33 solid with the face of the flange 29*a* opposite to the one forming the guiding path to the rollers 28 and extending parallel to the axis X-X'. The brackets 33 are fastened to fixed emplacments of supporting housing of the drum 1 by fastening screws or by shouldered pins (not shown) passing through oblong holes 33*a* of the brackets 33 in order to prevent the rotation of the element 29 while allowing a translational motion through the adjusting means. A toothed crown 34 is fastened to a fastening flange 31*a* of the cylindrical piece 31 through appropriate means, such as fastening screws. A moto-reductor 35 is secured to the supporting housing 1 and its output shaft carries a pinion 36 driving the toothed crown 34 through a chain.

The flange 29*a* of element 29 includes on its guiding path face for the rollers 28 a cam part 29*b* permitting the increase of the distance of the movable bars 10 with respect to the stationary bars 9 at the upper part of the travel of the bars 9, 10 to disengage elongated produce H eventually jammed between the stationary bars 9 and the movable bars 10.

The operation of the sorting apparatus follows already from the description which has been made here above and will now be briefly stated.

Figure 2:
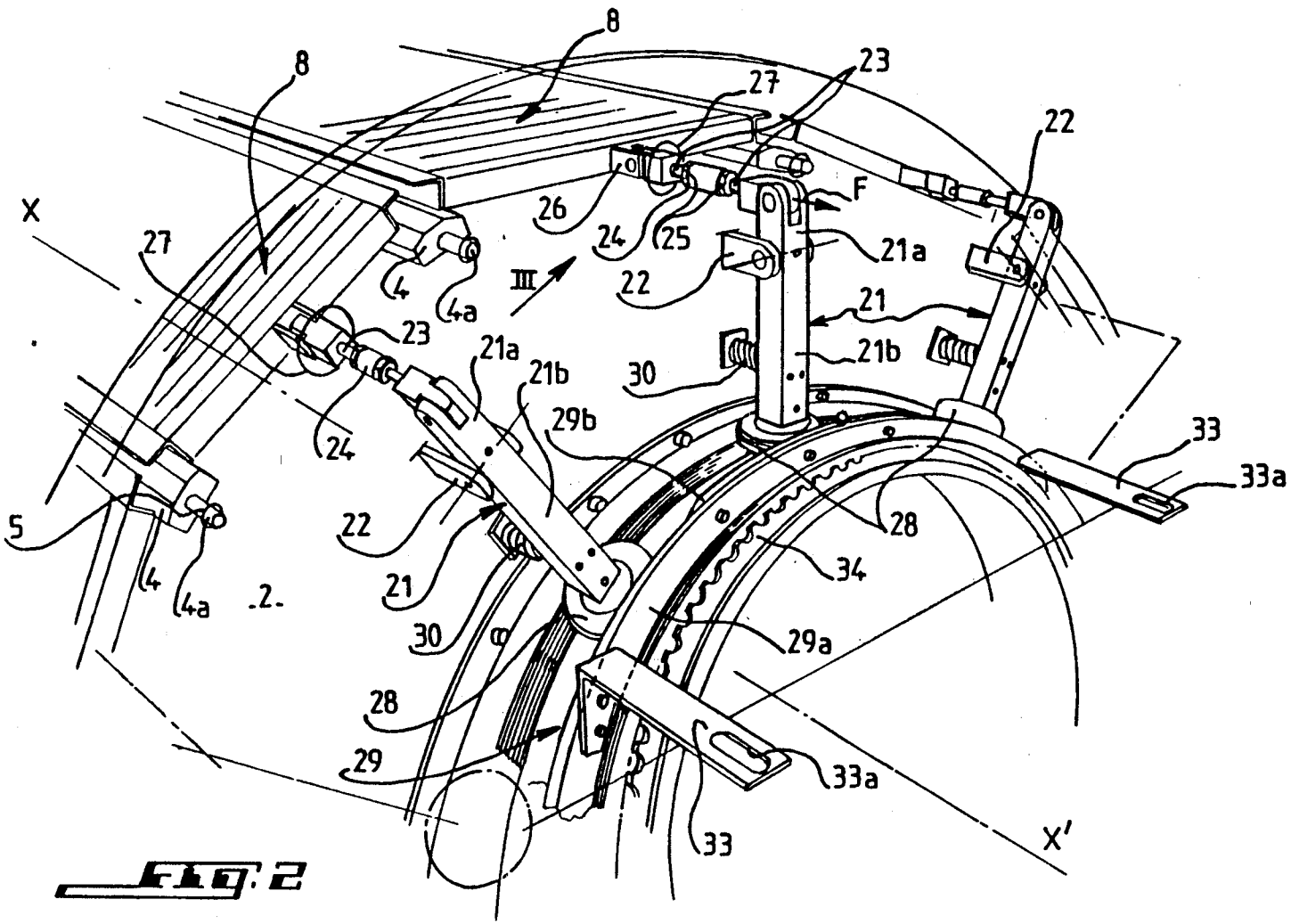
FIG. 2 is a partial perspective view along arrow II of FIG. 1.

When the drum 1 is driven in rotation, the elongated produce introduced into the entry of the drum is automatically sorted by passing through the sorting intervals for produce, the sizes of which are lower or practically equal to these intervals previously adjusted. The sorting intervals can be adjusted when the drum is stopped as well as during the rotation thereof by supplying the moto-reductor 35 in one determined rotating direction in order to rotate in accordance with the rotating direction of the driving pinion the crown 34 and thereby the cylindrical piece 31. A rotation of the piece 31 involves an axial translational motion of the element 29 which is clamped in rotation by the fastening screws of the brackets 33. An axial displacement of the element 29 pivots the arms 21 in a direction which either pulls the frames 17 as indicated by arrow F in FIG. 2 in order to decrease the sorting interval d, or pushes back the frames 17 in the direction opposite to arrow F in order to increase the sorting interval. Once the sorting intervals are adjusted to the desired size, the moto-reductor 35 is disabled and the fastening screws of the bracket 33 are screwed for maintaining the element 29 in a fixed position.

Figure 5:
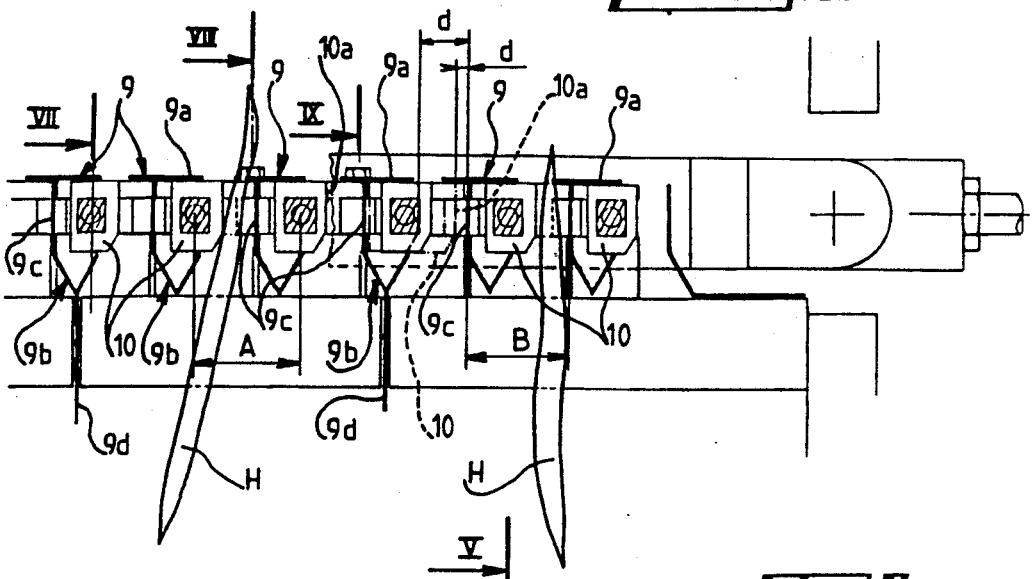
FIG. 5 is a sectional view along line V—V of FIG. 4.
Figure 4:
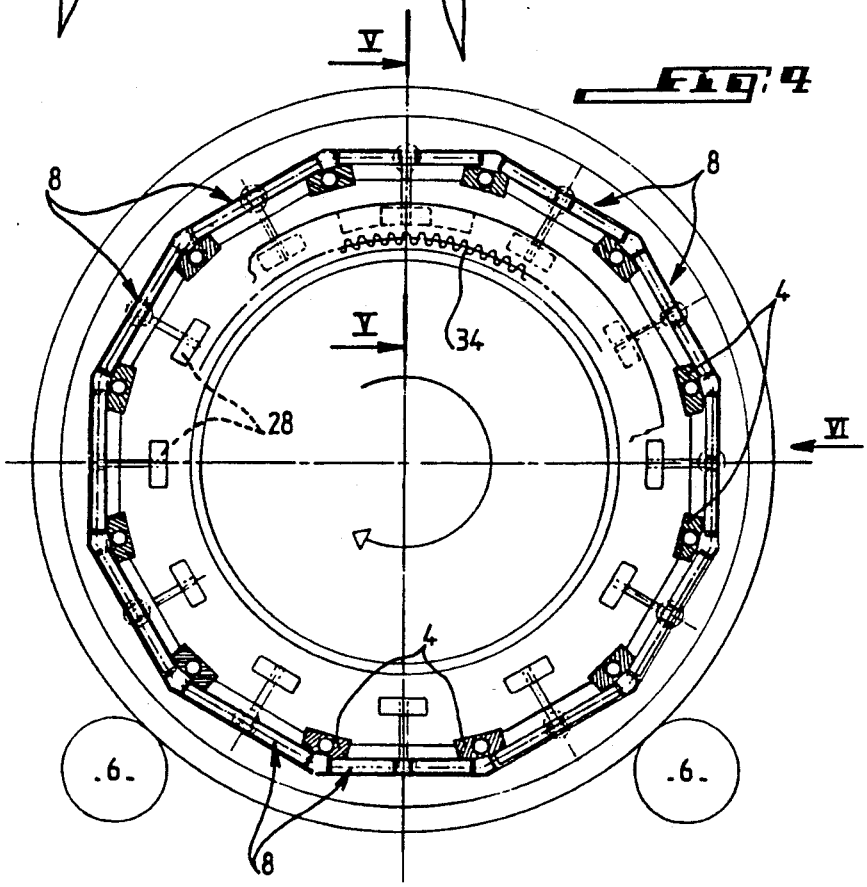
FIG. 4 is a cross-sectional view along line IV—IV of FIG. 1.
Figure 6:
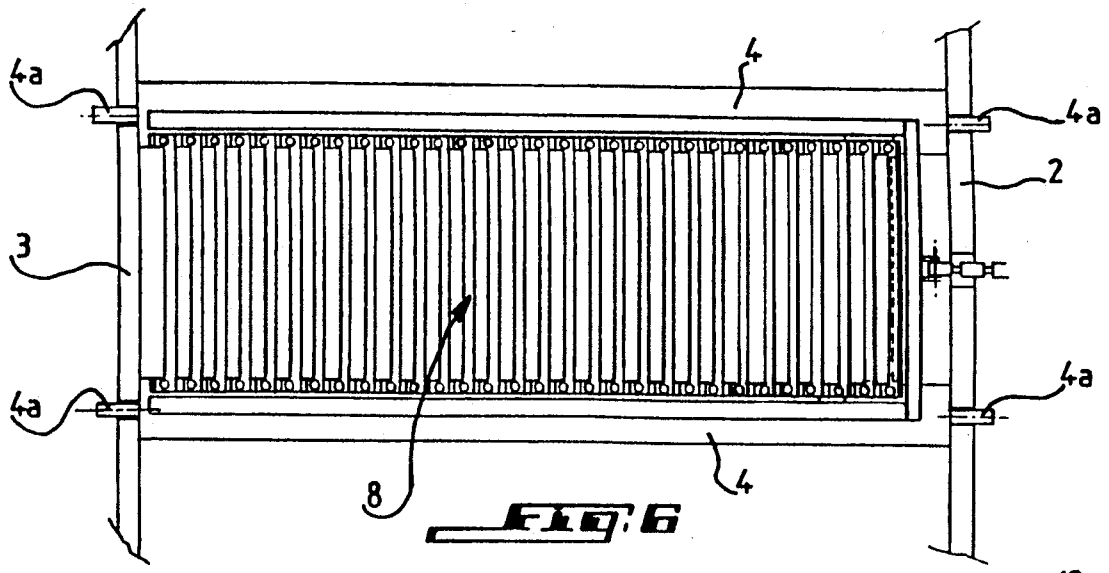
FIG. 6 is a view along arrow VI of FIG. 4.
Figure 7:
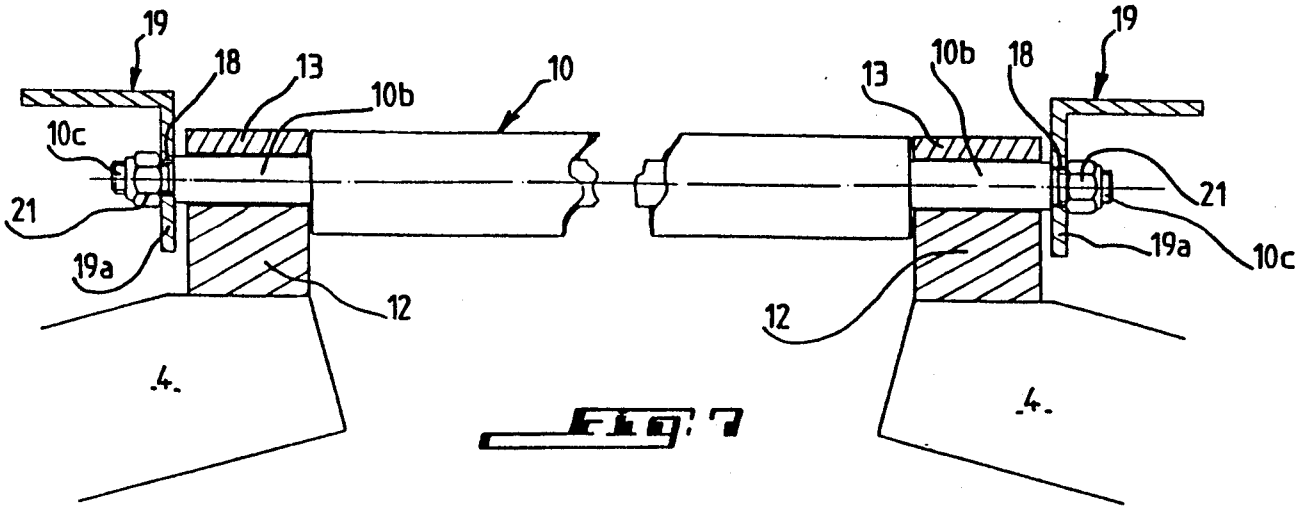
FIG. 7 is a sectional view along line VII—VII of FIG. 5.

It is possible to obtain an adjusting accuracy of the sorting intervals d corresponding to 1/400 of millimeter depending upon the micrometric pitch of the thread of the sleeve 31, the length of the levers 21 and the demultiplication ratio of moto-reductor 35—driving pinion—toothed crown 34 assembly. Moreover, once adjusted, the sorting interval does not vary even if wear occurs, due to the friction or abrasion of the material between the joining pieces 10*b* of the movable bars 10 and the walls of the apertures 15 guiding these joining pieces. The distance or interval A (FIG. 5) separating two successive movable bars is regorously constant, such a distance being easily obtained by drilling holes through the angle steels 19 intended to receive fingers 10c. Likewise, the distance B identical to the distance A, separating two successive stationary bars 9 is rigorously constant and can be easily obtained by drilling holes for the passage of screws 16 through plate 13, the studs 14 and the small bars 11 as well as by the notches 12a of the small bar 12.

The sorting apparatus according to the present invention can be advantageously used in combination with an inner drum as described in U.S. Pat. No. 4,873,105 granted on Oct. 10, 1989 in the name of the applicant. More precisely, this inner drum will be mounted coaxially to the drum 1 and solid in rotation therewith and being provided with at least one strip wound in an helicoidal manner around its axis like at least one screw thread and with radial walls extending in a parallel direction with the longitudinal axis of the drum while being angularly spaced from one another so as to delimit with the turns of the helicoidal strip, compartments for receiving and transporting the treated produce in order to lower the height of fall of the produce and avoiding a deterioration of the produce in particular due to the abrasion of the bottom in motion of the drum 1.

What is claimed is:

1. An apparatus for sorting elongated produce, comprising:

a rotatable drum having a longitudinal axis, said drum being constituted by a plurality of longitudinal grids;

each of said plurality of longitudinal grids including a frame movable along a direction parallel to the longitudinal axis of the drum, and a plurality of stationary bars disposed transversely to the longitudinal axis;

a plurality of movable bars fixedly mounted on said frame transversely to the longitudial axis of the drum, each of said plurality of movable bars being spaced along said frame at a constant, identical distance with respect to each other, said plurality of stationary and movable bars being disposed adjacent and alternatively to each other to form sorting intervals therebetween, and wherein said frame moves relative to said stationary bars so as to adjust the size of the sorting intervals; and means disposed on said drum for moving said frame of each of said plurality of longitudinal grids to adjust the size of the sorting intervals therein.

2. The apparatus of claim 1, wherein each of the longitudinal grids includes two stationary supporting bars disposed between annular flanges of said drum and extending parallel to the longitudinal axis of the drum, each of said supporting bars including a longitudinal row of non-circular apertures.

3. The apparatus of claim 2, wherein each of said movable bars have opposed ends and a joining piece disposed on each end, each joining piece having a shape complimentary to said non-circular apertures so as to pass through and be axially guided therein and wherein each joining piece is secured to a respective frame at its free end.

4. The apparatus of claim 3, wherein each of said non-circular apertures is lined with a material having a capacity to resist wear.

5. The apparatus of claim 4, wherein said material is chrome.

6. The apparatus of claim 3, wherein each joining piece has a square cross-section and is guided through a respective aperture of said supporting bar with a very small clearance.

7. The apparatus of claim 2, wherein each of said supporting bars includes a small bar, a plurality of spacer studs spaced longitudinally along said small base bar and an elongated plate mounted on and extending along said plurality of spacer studs to form said non-circular apertures.

8. The apparatus of claim 7, further comprising a plurality of longitudinal beams disposed between the annular flanges of said drum and mounted circumferentially along said drum, each of said beams being shaped as a hexagonal prism including a wide surface and a narrow surface spaced parallel thereto and two prism surfaces adjacent said narrow surface.

9. The apparatus of claim 8, wherein each of the prism sufaces of the longitudinal beam supports a small base bar of adjacent grids.

10. The apparatus of claim 8, wherein each stationary bar includes an upper flat portion secured at both ends to a respective elongated plate of said supporting bars by a fastening screw passing through said elongated plate, said spacer stud and said small base bar screwing into a threaded blind hole of a corresponding longitudinal beam, and a bucket-shaped part which opens laterally toward a lateral wall of a bucket-shaped part of an adjacent stationary bar, so that a movable bar is movable between a position inside the bucket-shaped part of a stationary bar and a position close to the lateral wall of the bucket-shaped part of the adjacent stationary bar.

11. The apparatus of claim 10, wherein some of the plurality of stationary bars include a deflector portion connected to said bucket-shaped part extending towards and being substantially perpendicular to said longitudinal axis.

12. The apparatus of claim 3, wherein said frame includes a longitudinal angled steel portion disposed on each side and wherein said free end of each of said joining pieces of said movable bar passes through said angled steel portion and is secured thereto through a fastening nut.

13. The apparatus of claim 2, wherein each means for moving said frame of each of said longitudinal grids includes a radial lever pivotally mounted outside the drum through a fork joint connected to one of the annular flanges of the drum, said radial lever having first and second ends.

14. The apparatus of claim 13, further comprising a lever arm having opposed ends, one end being mechanically coupled to the first end of said radial lever and the other end being attached to a cross piece extending between the longitudinal angled steel portion of the frame.

15. The apparatus of claim 13, further comprising a non-rotatable movable element associated with the second end of said radial lever, movable in an axial translational movement simultaneously with the adjustment of the size of the sorting intervals and axially securable once the adjustment has been made, and an assembly for controlling said movable element.

16. The apparatus of claim 15, further comprising a roller fixed to the second end of said radial lever and parallel with the longitudinal axis.

17. The apparatus of claim 15, wherein said movable element comprises a nut which moves in micrometric displacements along a sleeve rotatably mounted on a cylindrical piece attached to one of the annular flanges and coaxial with the longitudinal axis of the drum, the moving element including a flange which forms a guiding path for the roller.

18. The apparatus of claim 15, wherein said movable element includes a plurality of brackets fastened to stationary emplacements disposed on said drum through fastening devices which extend through oblong holes formed in the brackets so as to prevent rotation of the movable element while permitting translational movement produced through said means for moving the frame.

19. The apparatus of claim 15, wherein said annular flange includes a cam part for increasing the distance between the movable bars and the stationary bars at an upper part of their travel to disengage produce which becomes jammed between the bars.

20. The apparatus of claim 14, wherein an elastic biasing element is mounted prestressed between the annular flange and said lever arm of each of said radial levers.

21. An apparatus for sorting elongated produce, comprising:

a rotatable drum having a longitudinal axis, said drum being constituted by a plurality of longitudinal grids;

each of said plurality of longitudinal grids including a frame movable along a direction parallel to the longitudinal axis of the drum, and a plurality of stationary bars disposed transversely to the longitudinal axis;

a plurality of moavable bars fixedly mounted on said frame transversely to the longitudinal axis of the drum, each of said plurality of movable bars being spaced along said frame at a constant, identical distance with respect to each other, said plurality of stationary and movable bars being disposed adjacent and alternatively to each other to form sorting intervals therebetween, and wherein said frame moves relative to said stationary bars so as to adjust the size of the sorting intervals;

each of said plurality of longitudinal grids including two stationary supporting bars disposed between annular flanges of said drum and extending parallel to the longitudinal axis of the drum, each of said supporting bars including a longitudinal row of non-circular apertures, the stationary bars being fixed to the stationary supporting bars at both ends;

movable bars having opposed ends and a joining piece disposed on each end, each joining piece having a shape complimentary to said non-circular apertures so as to pass through and be axially guided therein and wherein each joining piece is secured to a respective frame at its free end; and means disposed on said drum for moving said frame of each of said plurality of longitudinal grids to adjust the size of the sorting intervals therein.

* * * * *